US005743318A

United States Patent [19]

Ruggles et al.

[11] Patent Number: 5,743,318

[45] Date of Patent: Apr. 28, 1998

[54] VERTICAL WINDOW SHADE

[75] Inventors: Bryan K. Ruggles; Jace N. Green, both of Salt Lake City, Utah; Richard F. Chacon, Brea, Calif.

[73] Assignee: Newell Operating Company, Freeport, Ill.

[21] Appl. No.: 619,822

[22] Filed: Mar. 15, 1996

Related U.S. Application Data

[63] Continuation-in-part of Ser. No. 263,058, Jun. 21, 1994, abandoned.

[51] Int. Cl.[6] ..... E06B 9/30

[52] U.S. Cl. ..... 160/168.1 V; 160/89; 160/236

[58] Field of Search ..... 160/89, 127, 166.1 V, 160/168.1 V, 176.1 V, 113, 115, 178.1 V, 126, 236, 405, 38, 39

[56] References Cited

U.S. PATENT DOCUMENTS

| | | |
|---|---|---|
| 1,937,342 | 11/1933 | Higbie . |
| 2,267,869 | 12/1941 | Loehr . |
| 2,770,298 | 11/1956 | Hiatt . |
| 2,914,122 | 11/1959 | Pinto . |
| 2,994,370 | 8/1961 | Pinto . |
| 3,092,870 | 6/1963 | Baer . |
| 3,302,690 | 2/1967 | Hurd . |
| 3,411,561 | 11/1968 | Mock . |
| 3,422,878 | 1/1969 | Galietti . |
| 3,844,330 | 10/1974 | Hyman . |
| 3,851,699 | 12/1974 | Shapiro . |
| 3,946,789 | 3/1976 | Ronkholz-Tölle, nee Tölle . |
| 4,114,233 | 9/1978 | Hamilton . |
| 4,438,605 | 3/1984 | DeLucia . |
| 4,846,243 | 7/1989 | Schneider . |
| 5,012,552 | 5/1991 | Wulf . |
| 5,090,098 | 2/1992 | Seveik et al. . |
| 5,097,884 | 3/1992 | Sevcik et al. . |
| 5,099,904 | 3/1992 | Susnar . |
| 5,102,598 | 4/1992 | Chen . |
| 5,105,870 | 4/1992 | Merjane . |
| 5,129,440 | 7/1992 | Colson . |
| 5,143,136 | 9/1992 | John . |
| 5,158,632 | 10/1992 | Colson et al. . |
| 5,287,908 | 2/1994 | Hoffmann et al. . |
| 5,313,998 | 5/1994 | Colson et al. . |
| 5,339,883 | 8/1994 | Colson et al. . |
| 5,392,833 | 2/1995 | Ohanesian . |
| 5,419,385 | 5/1995 | Vogel et al. . |
| 5,425,408 | 6/1995 | Colson . |
| 5,490,553 | 2/1996 | Colson et al. . |

FOREIGN PATENT DOCUMENTS

| | | |
|---|---|---|
| 0653539 | 5/1995 | European Pat. Off. . |
| 0654577 | 5/1995 | European Pat. Off. . |
| W9425719 | 11/1994 | WIPO . |

*Primary Examiner*—David M. Purol
*Attorney, Agent, or Firm*—Foley & Lardner

[57] ABSTRACT

A blind assembly includes a plurality of elongated main louvers and a pair of end louvers. Each louver has a front leading edge with an internal annular socket attached proximate the leading edge. Each end louver includes a rear socket having a rear semi-cylindrical interior. A plurality of adjacent fabric strips form a curtain. Each fabric strip includes a pair of marginal edges, each edge having a semi-cylindrical bead attached thereto. Adjacent beads form a cylindrical member which is received within the annular front sockets. The semi-cylindrical bead attached to each end of the curtain is received within the semi-cylindrical interior of the rear socket of each end vane. A clip supported by the top surface of each socket extends within the channel and supports the fabric strips. A weight located in a channel of each louver distal the leading edge acts as a counter balance to the weight of the front sockets and curtain.

25 Claims, 6 Drawing Sheets

FIG. 1
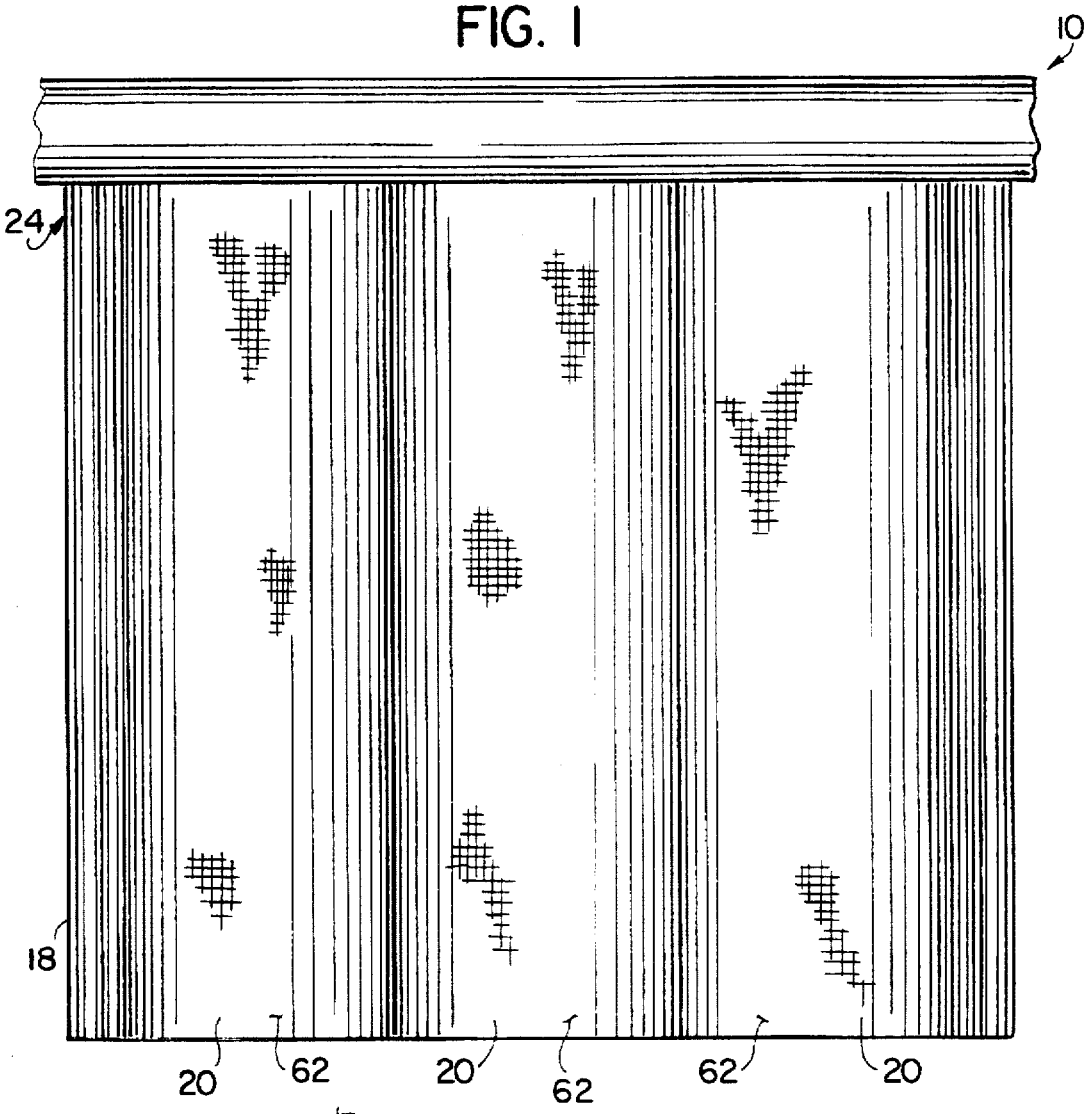
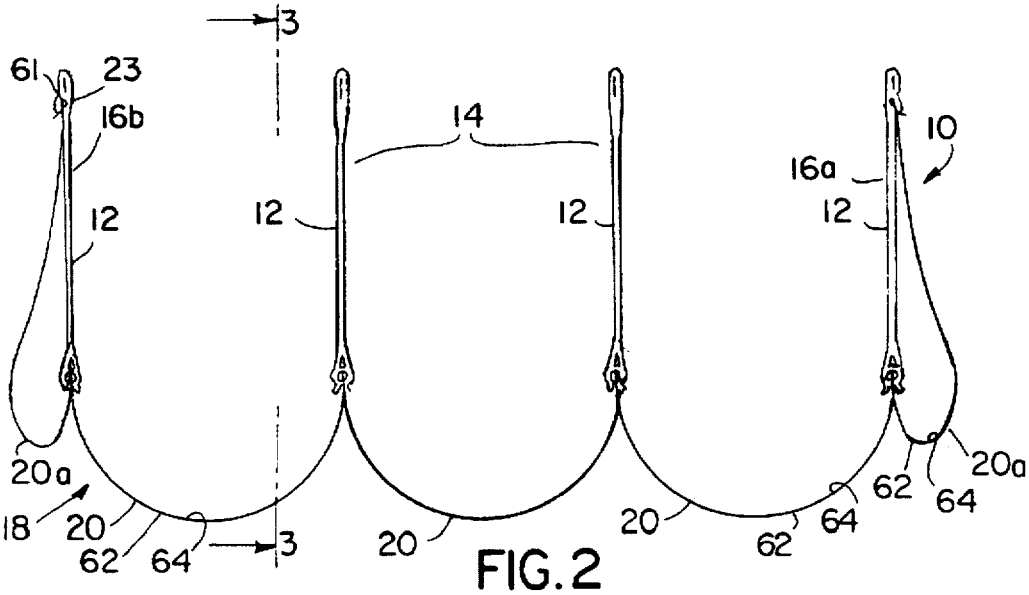
FIG. 2

72
100
110
112
108
8A
116
104
102
10
11
122
114
120

VERTICAL WINDOW SHADE

CROSS REFERENCE TO RELATED APPLICATIONS

This is a continuation-in-part of U.S. application Ser. No. 08/263,058 filed Jun. 21, 1994 now abandoned.

BACKGROUND OF THE INVENTION

The present invention relates generally to blind systems, and more particularly, to a vertical louver blind incorporating a plurality of elongated slats and an integral, sheer curtain face.

The advent of vertical louver-type blinds has brought about new concepts in interior design for commercial and residential installations. Vertical blind systems have been particularly well received in contemporary architecture where relatively large expanses of window glass are utilized or large room partitions are desired. The vertical blind may be of substantial vertical height and, when closed, may extend along a considerable horizontal length to cover a wall, a window, or to partition a room.

Conventional louvers, also called slats or vanes, of a vertical blind are adapted for lateral movement between an open blind position (when the blind is drawn to one or opposite ends of a support track or channel adjacent their tops) and a closed position (when the louvers are positioned in generally equal spaced relation to one another along the length of the support track or channel). The louvers are also adapted for selective rotation about their longitudinal axis between open and closed positions when in the closed blind position to control the amount of light entering between the louvers into or out of the adjacent room.

The vertical louvers may be made of vinyl or other suitable material, colored to add an accent color to the room or colored to blend with the primary color of the room. The louvers may also be made or covered with a fabric material to achieve a specific design effect.

SUMMARY OF THE INVENTION

The present invention includes a blind assembly comprising a plurality of elongated main louvers and a pair of end louvers. Each main louver and each end louver has a leading edge and a rear edge. Each main and end louver further includes a front socket adjacent the leading edge. The front socket has an interior. Each end louver includes a rear socket proximate the rear edge. The rear socket includes a rear interior. The blind assembly further includes a curtain including a first end and a second end. The curtain has a plurality of parallel spaced longitudinal members attached thereto. The curtain is disposed and passes adjacent each front leading edge of the main and end louvers. The first end of the curtain is adjacent the rear edge of one end louver and the second end of the curtain is adjacent the rear edge of the other end louver. Each longitudinal member fits within the front and rear sockets.

In accordance with another aspect of the invention a blind assembly includes a headrail, and a plurality of elongated louvers. Each louver being rotatably attached to the headrail at preselected, spaced relation to one another in a manner which enables each louver to rotate about a longitudinal axis of rotation. Each louver has a leading edge and a socket adjacent the leading edge. The socket includes an interior and a top surface. Each louver further includes a rear edge and an elongated channel proximate the rear edge. The blind assembly further includes a curtain having a plurality of parallel longitudinal members attached thereto. The curtain is disposed and passes adjacent each front leading edge. Each longitudinal member fits within the interior of the sockets. The blind assembly also includes a weight located within the channel proximate the rear edge configured to counterbalance the curtain and the members about the longitudinal axis of rotation.

In a further aspect of the invention the blind assembly includes a plurality of elongated louvers. Each louver has a leading edge and a socket adjacent the leading edge. The socket includes an interior, and a top surface. The blind assembly further includes a plurality of clips. Each clip is suspended proximate the top surface of the socket. The blind assembly further includes a curtain including a plurality of parallel longitudinal members attached thereto. The curtain is disposed and passes adjacent each front leading edge. Each longitudinal member fits within the interior of the socket and is attached to the clip.

An embodiment of the process for making a vertical blind assembly including a curtain and a plurality of louvers includes the step of forming a plurality of fabric strips. Each fabric strip includes a pair of marginal edges having a first and second bead attached thereto. Another step includes forming a plurality of cylindrical members from the first bead of one fabric strip and the second bead of an adjacent fabric strip. A further step includes attaching each cylindrical member within a socket proximate a front edge of the louvre.

An embodiment of an apparatus for making a vertical blind assembly, including a plurality of fabric strips and a plurality of louvers, each louver having a socket, includes a cutting station. The cutting station is configured to transversely cut a fabric web to form a fabric strip. The fabric web includes a pair of marginal edges having a first and second bead attached thereto. The apparatus also includes a clamping station having a clamp to hold a first bead of a first fabric strip and a second bead from a second fabric strip to form a cylindrical member. The apparatus further includes a retractable slide having a gripper to grip a free end of the fabric web. The retractable slide simultaneously conveys the louver along the cylindrical member to locate the cylindrical member within the socket of the louver.

DESCRIPTION OF THE DRAWINGS

In order that the present invention may be more fully understood, it will now be described by way of example, with reference to the accompanying drawings in which:

FIG. 1 is a front view of a vertical blind system in the open position having vertical louvers;

FIG. 2 is a top sectional view of the longitudinal edge of the vertical blind system in the open position, with a curtain attached thereto;

DETAILED DESCRIPTION OF THE PREFERRED EMBODIMENT

Figure 3:
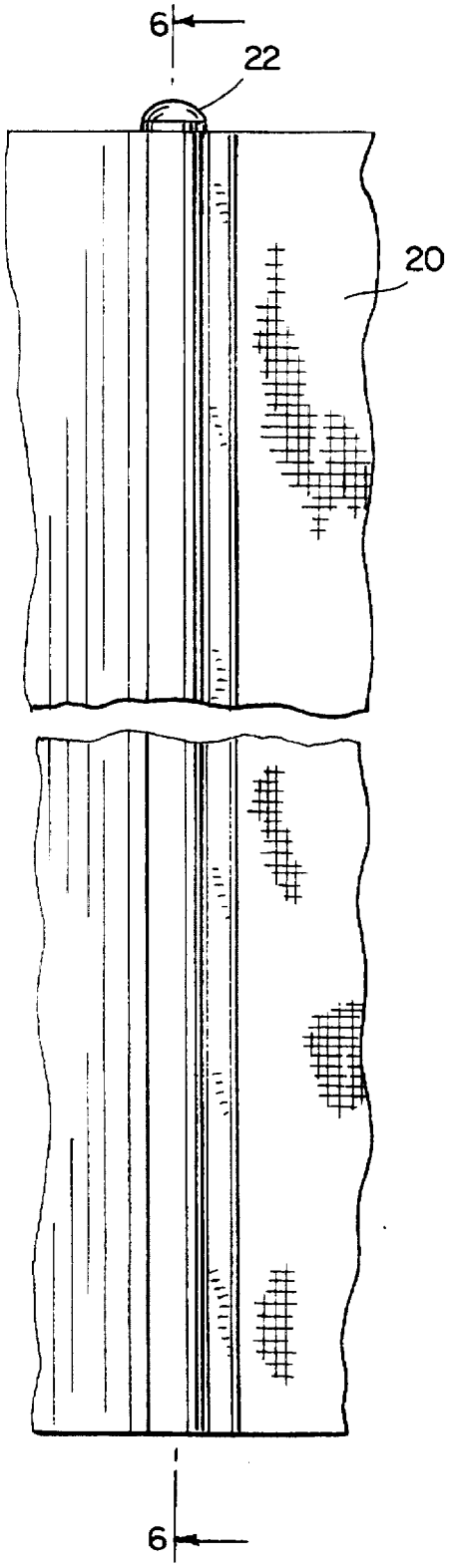
FIG. 3 is a side sectional view of a longitudinal edge of the louver and the curtain assembly attached thereto.

Referring generally to FIGS. 1 and 2, a vertical blind assembly 10 is illustrated. As shown in FIG. 2, blind assembly 10 includes a plurality of louvers 12. Louvers 12 comprise a plurality of main louvers 14, a first end louver 16*a* and a second end 16*b*. A curtain 18 includes a plurality of fabric strips 20 attached to louvers 12. Each fabric strip 20 is suspended from louvers 12 with a pair of clips 22.

Each louver 12 is supported adjacent an upper end 24 thereof so as to hang in a substantially vertical position. Louvers 12 hang at preselected, spaced relation to one another in a manner which enable each louver 12 to rotate about a longitudinal axis of rotation between an open louver position (FIG. 2) and a closed louver position (not shown).

Each louver 12 has a bottom edge 26, a top edge 28, a front, or leading longitudinal edge 30 and a back longitudinal edge 32. Louvers 12 are laterally sized so front edge 30 of each louver 12 overlaps back edge 32 of the next adjacent louver in the closed louver position.

Figure 4:
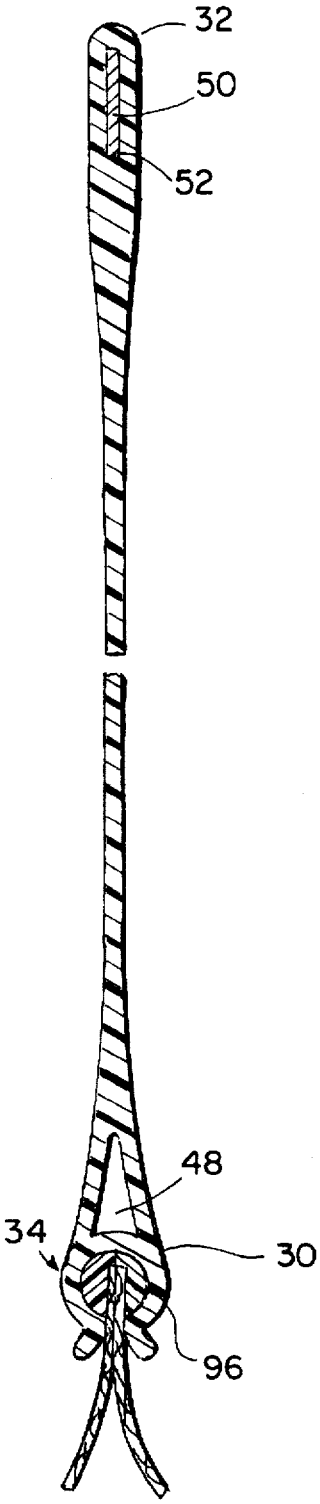
FIG. 4 is a cross sectional view of a louver.
Figure 7:
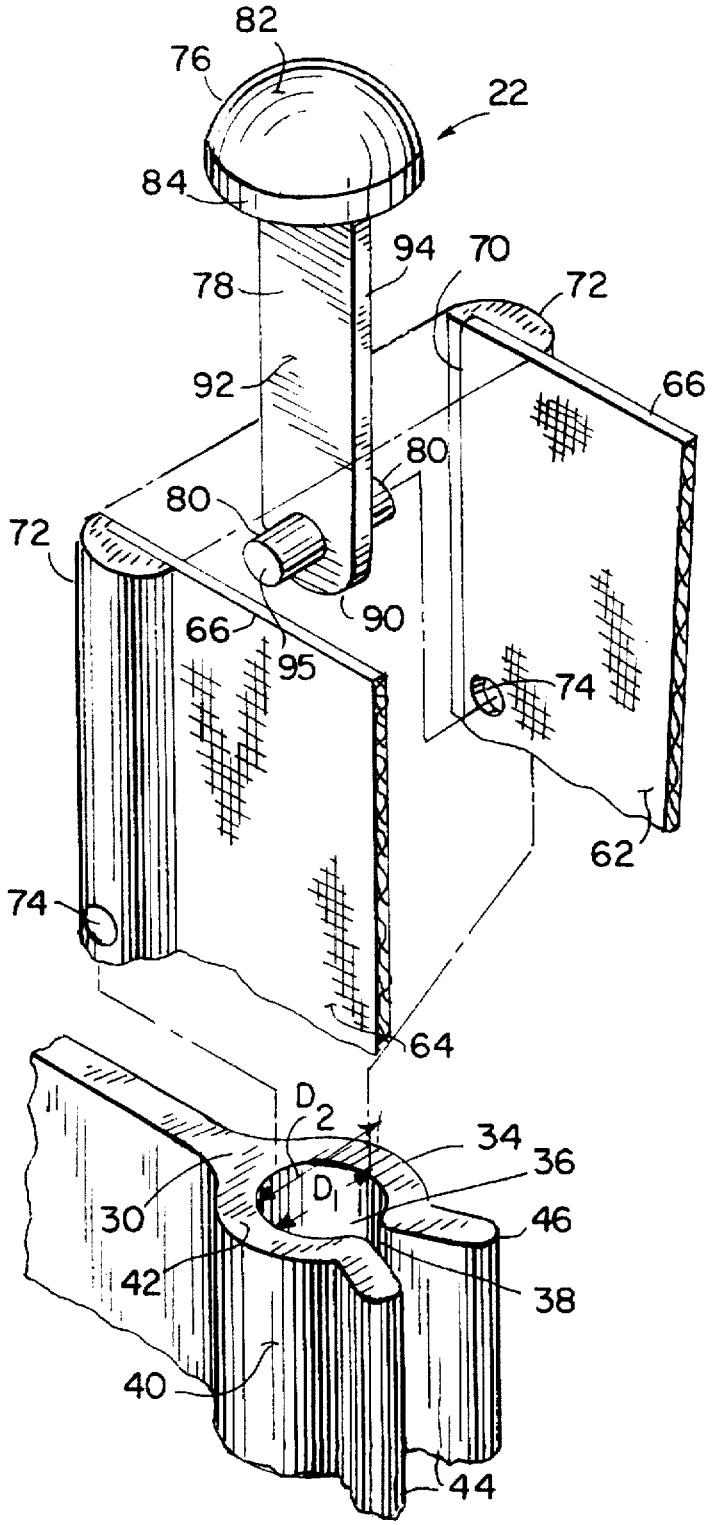
FIG. 7 is an exploded view of the louver, fabric strips with bead and clip of the vertical blind system.

Referring to FIGS. 4 and 7, each louver 12 includes a hollow cylindrical protuberance, or a socket 34 formed integral with front edge 30 of each louver 12. Socket 34 has an arcuate, generally cylindrical interior 36 and at the distal end of socket 34 there is a longitudinal passageway 38 that extends from cylindrical interior 36 to an exterior surface 40 thereof. Socket 34 has an inner diameter $D_1$ and an outer Diameter $D_2$. Socket 34 further includes a top surface 42 proximate top edge 28 of louver 12.

Extending from each socket 34 are a pair of projections 44 adjacent each side of longitudinal passageway 38. Each projection 44 includes a rounded end 46. Main louver 14 may also includes a longitudinal triangular shaped channel 48 proximate socket 34 in order to minimize the material proximate leading edge 30 (See FIG. 4).

Each main louver 14 further includes a weight 50 located within a longitudinal channel 52 proximate back longitudinal edge 32. However, as discussed below, it is possible not to include longitudinal channel 52 and weight 50.

Figure 5:
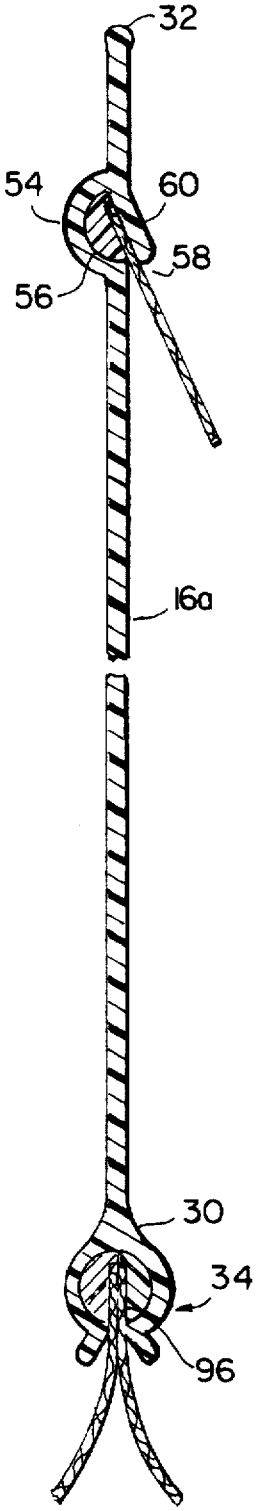
FIG. 5 is a cross sectional view of an end louver.

Referring to FIG. 5, each end louver 16*a*, 16*b* includes a rear socket 54 having a semi-cylindrical interior 56 and a rear longitudinal passageway 58 that extends from rear semi-cylindrical interior 56 to the exterior thereof. Rear socket 54 includes a flat portion 60 positioned at an angle to an axis formed between front edge 30 and rear edge 32. Although not shown, flat portion 60 of rear socket 54 may include a projection extending at a non-parallel angle from flat portion 60. Rear socket 54 further includes a top surface proximate top edge of louvers 16*a*, 16*b*. As shown in FIG. 2, when blind assembly 10 is in the open position, each end louver 16*a*, 16*b* is oriented such that rear longitudinal passageway 58 faces outward from main louvers 14.

Figure 15:
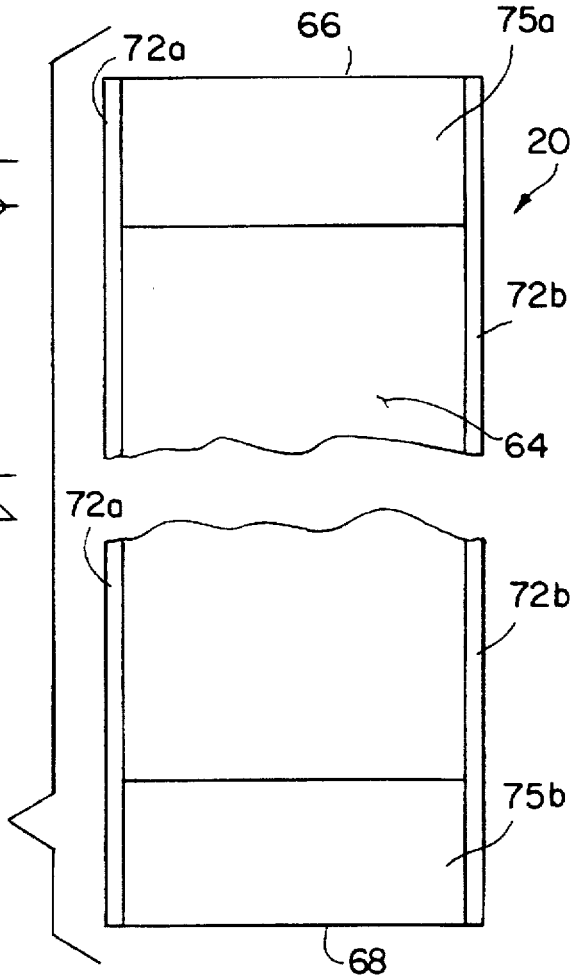
FIG. 15 is a schematic view of the fabric strip with beads and hem.

Referring to FIGS. 2, 7 and 15, each fabric strip 20 includes a front surface 62, a rear surface 64, a top edge 66, a bottom edge 68, and a pair of longitudinal edges 70. A semi-cylindrical bead 72 extends substantially the entire length of fabric strip 20 and is attached to or laid upon rear surface 64 adjacent each longitudinal edge 70 as will be more fully described below. In this manner each fabric strip 20 includes a first bead 72*a* proximate one longitudinal edge 70 and a second bead 72*b* proximate the other longitudinal edge 70.

In the preferred embodiment, beads 72 are extruded onto rear surface 64 of fabric strip 20 such that each bead 72 extends beyond each longitudinal edge 70 thereby capturing and covering all loose fibers and yarns. This prevents fraying which can occur over time. However, beads 72 may have other configurations as well. For example, beads 72 may extend up to but not beyond each longitudinal edge 70.

An aperture 74 extends through each bead 72 and fabric strip 20 a predetermined distance from top edge 66 of fabric strip 20.

Fabric strip 20 further includes a top hem 75*a* and a bottom hem 75*b*. Top and bottom hems 75*a*, 75*b* extend laterally across fabric strip 20, proximate top and bottom edges 66, 68 respectively. Top hem 75*a* and bottom hem 75*b* may be affixed to front surface 62 and/or rear surface 64.

Figure 6:
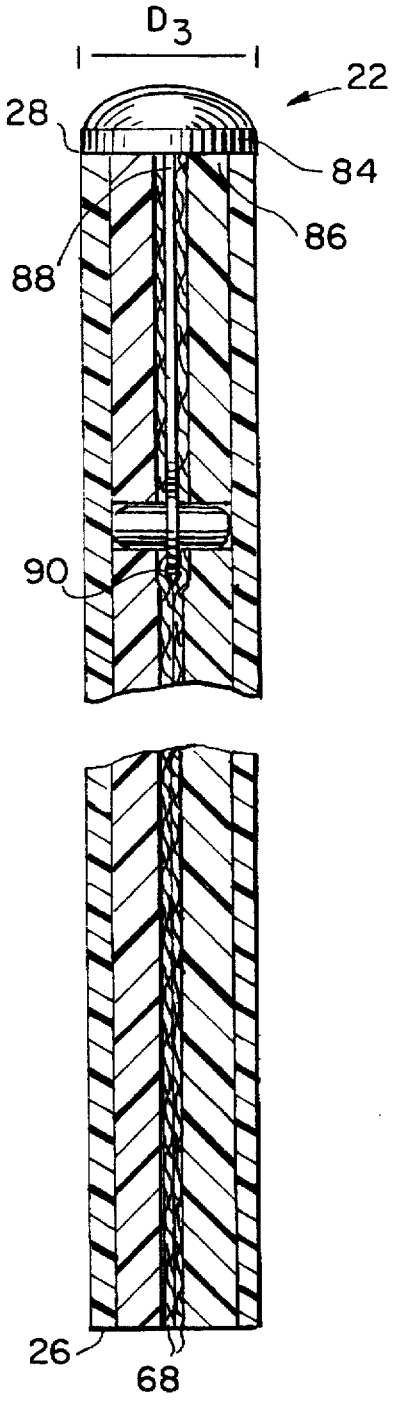
FIG. 6 is a detail side sectional view of a louver and the curtain assembly attached thereto.

Referring to FIGS. 6 and 7, clip 22 includes a head 76, a planar member 78 and a pair of cylindrical tabs 80. Head 76 has a cylindrical form having a diameter D3 substantially equal to the diameter D2 of socket 34. Head 76 includes a top surface 82 which in the preferred embodiment is generally hemispherical in form. However top surface 82 of head 76 may have other forms as well, such as planar.

Head 76 also includes a cylindrical wall 84 extending from top surface 82 to a bottom planar surface 86. Planar member 78 includes a top end 88, a bottom end 90, a first pair of parallel surfaces 92, and a second pair of edges 94 normal to first pair of parallel surfaces 92. Planar member 78 is attached normal to bottom surface 86 of head 76 at top end 88 of planar member 78. In the preferred embodiment, planar member 78 is integrally formed with head 76. Bottom end 90 of planar member 78 may have an arcuate form. However, bottom end 90 may have other forms as well, such as a square.

Cylindrical tabs 80 extends normal to each parallel planar surface 92 proximate bottom end 90 of planar member 78. Cylindrical tabs 80 may extend from each parallel planar surface 92 a distance substantially equal to the radius of bead 72 and thickness of fabric strip 20.

Referring to FIG. 2, the cooperation of the fabric strips 20, louvers 12, and clips 22 will be described. Fabric strips 20 include a pair of end fabric strips 20*a* and a plurality of main fabric strips 20. An end fabric strip 20*a* is attached to rear socket 54 of end louver 16*a*. First bead 72*a* of end fabric strip 20*a* is located within rear socket 54. The radius of semi-cylindrical bead 72 is less than the radius of the semi-cylindrical rear socket 54. However the distance between flat portion 60 and socket 54 is less than the radius of bead 72. In this manner first bead 72*a* of end fabric strip 20*a* is retained within rear socket 54 and is not able to pass through longitudinal passageway 58.

End fabric strip 20*a* is supported in the vertical direction by a rear end clip 23. Rear end clip 23 includes a single cylindrical tab 80 which is inserted within aperture 74 of first bead 72*a* of end fabric strip 20*a*. Planar member 78 is positioned between front surface 62 of end fabric strip 20*a* and flat portion 60. Bottom surface 86 of clip head 76 is supported on top surface of rear socket 54. In this manner a first longitudinal edge 70 of an end fabric strip 20 is retained in the vertical position by rear end clip 23.

Second longitudinal bead 72b of end fabric strip 20a together with a first bead 72a of an adjacent fabric strip 20 forms a cylindrical member 96. In this manner one semi-cylindrical bead 72 from one end fabric strip 20a forms half the cylindrical member 96 and the other semi-cylindrical bead 72 from the adjacent fabric strip 20 forms the other half of the overall cylindrical member 96. In this position the longitudinal edges 70 of end fabric strip 20a and adjacent fabric strip 20 are aligned with one another and fabric strips 20a and 20 are orientated with their front surfaces 62 against one another proximate cylindrical member 96.

Clip 22 is attached to fabric strips 20 by inserting one cylindrical tab 80 in each aperture 74. Once clip 22 is attached, two beads 72 forming a cylindrical member 96 may be slid or threaded into front socket 34 such that the bottom surface 86 of clip head 76 is supported by top surface 42 of front socket 34.

Subsequent fabric strips 20 are similarly attached to main louvers 14 to provide a finished blind assembly. The number of fabric strips 20 and louvers 12 utilized are determined by the overall area the blind assembly 10 is desired to cover. As illustrated in FIG. 2, blind assembly 10 is finished with a second end louver 16b and end fabric strip 20a.

Figure 12:
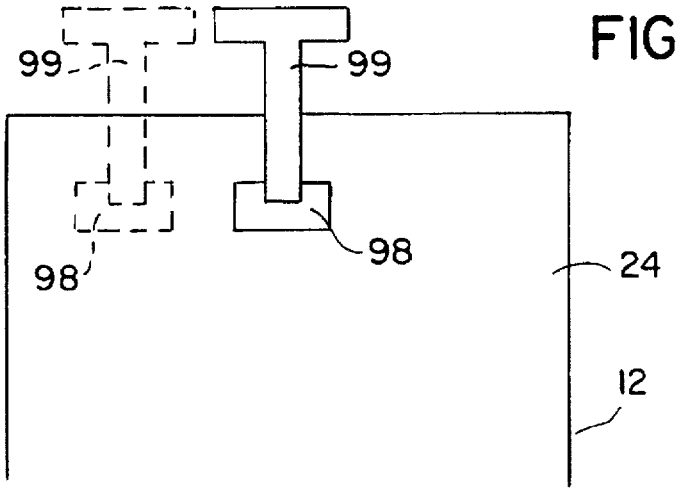
FIG. 12 is a detail of the top of the louver.

As previously noted, each louver 12 is free-hanging and supported adjacent its upper end 24. Specifically, as shown in FIG. 12, each louver 12 has an aperture 98 therein positioned below the top edge for receiving a hook (not shown). The hook is at the distal end of an arm 99 extending from a carrier. Each carrier is positioned and controlled in the headrail of blind assembly 10.

Aperture 98 is centrally disposed between the front edge 30 and back edge 32 of louver 12. This is shown in solid lines in FIG. 12. In this manner, louver 12 is balanced to hang substantially vertical. As noted above, leading edge 30 includes front socket 34 with both cylindrical member 96 and attached curtain 18 interconnected thereto which increases the weight proximate leading edge 30.

To accommodate and compensate for the weight and the resulting moment, aperture 98 in louver 12 may be shifted forwardly. The shifting or off-setting is shown in phantom lines in FIG. 12 with an aperture 98 and arm 99. As a result, with the shifting and hanging from the center of gravity, the louvers hang freely and vertically. The louvers may also be made into a curved configuration for rigidity and uniformity.

As illustrated in FIG. 4 weight 50 located within longitudinal channel 52 acts as a counterbalance to front socket 34, cylindrical members 96, and curtain 18. The use of weight 50 permits aperture 98 to be centrally located within louver 12.

The process of manufacturing and attaching fabric strips 20 to louvers 12 includes a bead application step and hemming, punching, cutting, and assembly steps.

Figures 8, 8A, 9:
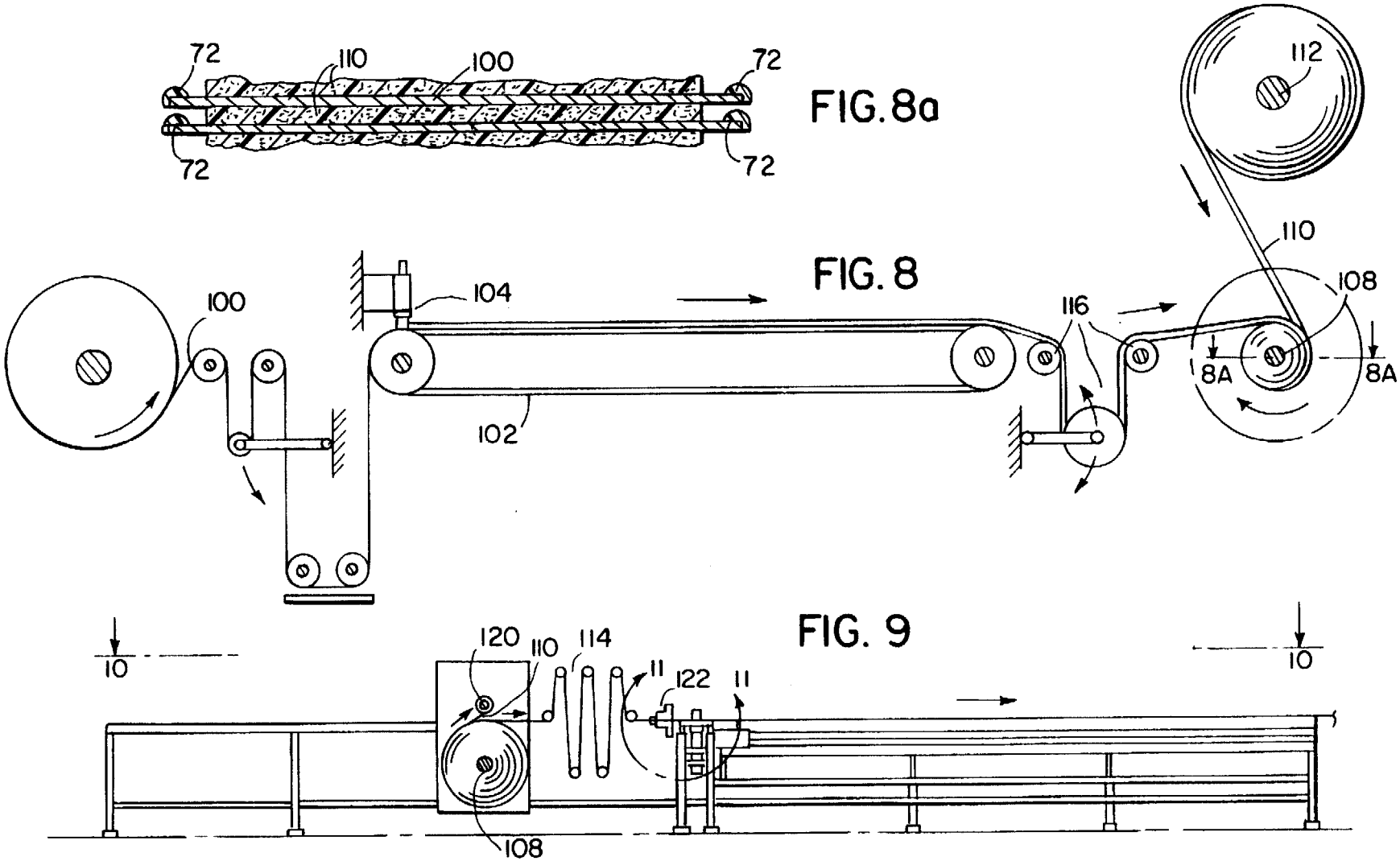
FIG. 8 is a schematic view of the bead application system.
FIG. 8A is a schematic cross-sectional view of the fabric web and foam interleaf.
FIG. 9 is a schematic view of the fabric and louver assembly system.

Referring to FIG. 8 the bead application step will be now be described. A roll of fabric web 100 from which fabric strips 20 will be formed is first slit to the preferred width W (not shown). In the preferred embodiment width W is determined to be the length of half of the circumference of a diameter equal to the distance between two adjacent vanes. In a preferred embodiment the distance between two vanes in the open position is 3.125 inches. Therefore width W of fabric strips 20 is approximately 5.125 inches. This particular geometry causes fabric strip 20 to billow out between open louvers in a substantially smooth curve. Of course other widths and relationships may be utilized.

Figure 13:
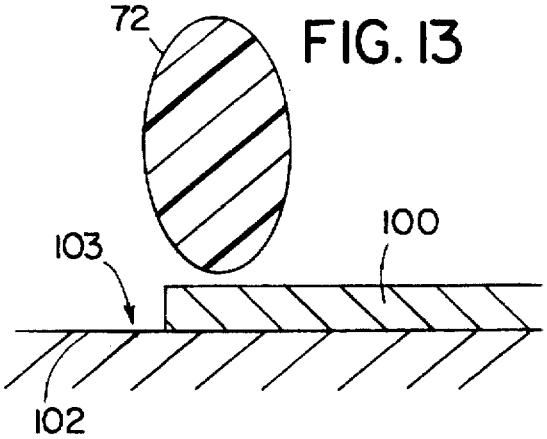
FIG. 13 is a schematic of the extruded cylindrical bead as it leaves the nozzle; and, FIG. 14 is a schematic of the cylindrical bead forming on the fabric.
Figure 14:
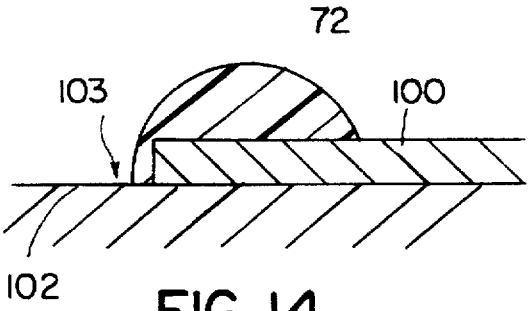

Fabric web 100 once slit to the appropriate width is fed onto a conveyor belt 102 having a non stick surface 103. Fabric web 100 is guided under a pair of glue nozzles 104 as it is pulled along belt 102. Nozzles 104 are positioned over longitudinal fabric edges and a hot polyeurethane reactive glue is extruded through nozzles 104 onto a rear side of moving fabric web 100. In the preferred embodiment the temperature of the extruded glue is about 120 degrees C. Beads 72 are extruded in a semi-elliptical shape with the tall axis of the ellipse oriented vertically. (see FIGS. 13 and 14). As the glue is cooling, its viscosity is tailored to allow it to flatten out into a semi-circular shape with a portion of bead 72 extending off longitudinal fabric edge onto non-stick belt 102. This allows bead 72 to totally bind the edges of fabric web 100. Bead 72 has a bead radius R.

In the preferred embodiment belt 102 has a length of 40 feet and travels at a speed in the range of 20–50 feet per minute. This allows time for beads 72 to harden to a tack-free state at the end of belt 102. Fabric web 100 with beads 72 is "peeled off" at the end of belt 102. Fabric web 100 then travels through a series of rollers 106 to a rewind spool 108 having a six inch diameter core. However, the diameter of the core may vary.

A foam interleaf 110 fed from roller 112 is interwound with fabric web 100 between beads 72. Foam interleaf 110 acts as a bridge for the portion of fabric web 100 intermediate beads 72. Foam 110 prevents fabric web 100 from being wound unevenly on spool 108. In the preferred embodiment, foam 110 is at least as thick as bead radius R and has a width less than the width of fabric web 100 (See FIG. 8A). However, other form thicknesses may be used.

When a desired length of fabric web 100 is wound, rewind spool 108 is doffed and stored until cured enough for assembly. In the preferred embodiment, fabric web with beads 72 are cured approximately two weeks to permit the beads to harden which results in a low coefficient of friction.

Figure 10:
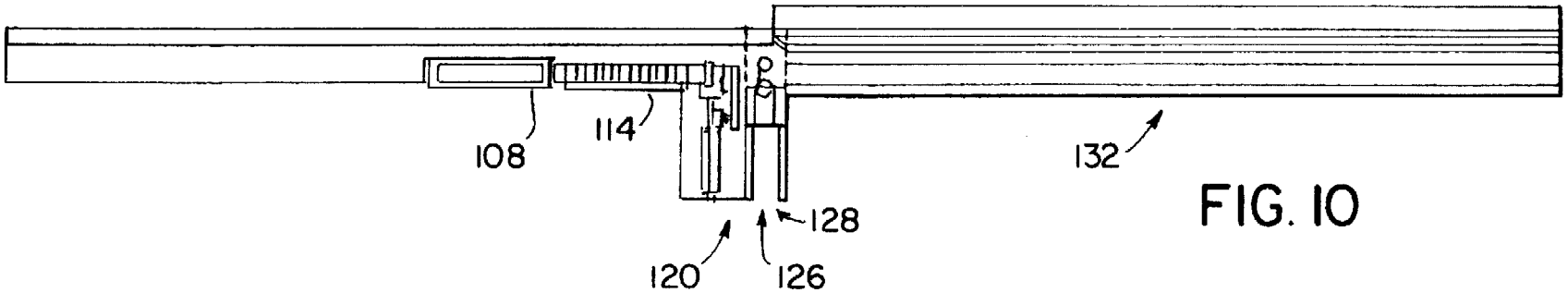
FIG. 10 is a top view of the fabric and louver assembly system.
Figure 11:
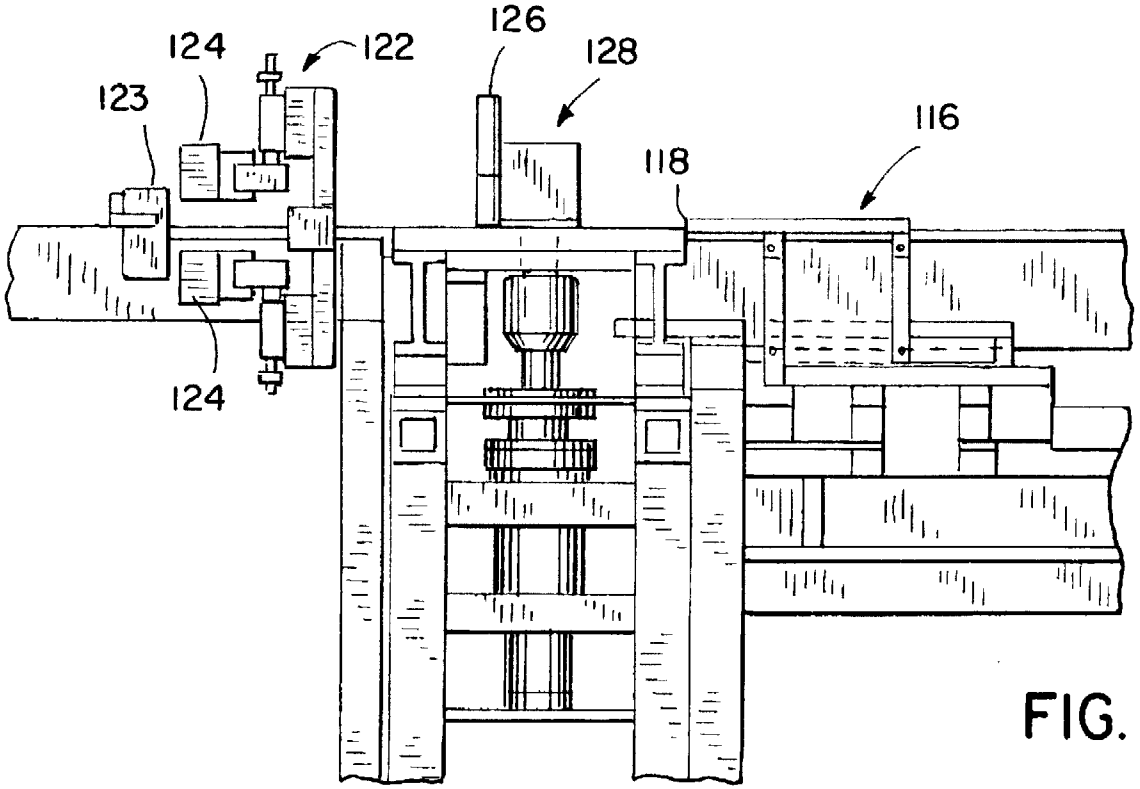
FIG. 11 is a schematic side view of a section of the fabric and louver assembly system.

Referring to FIGS. 9–11 the processing of fabric strips 20 and assembly of vertical blind system 10 will now be described. Fabric web 100 with cured beads 72 is unwound from fabric web roll spool 108 though a series of rollers 114 to a retractable slide 116 having a grip member 118. A take up roll 120 takes up foam 110 as a leading edge of fabric web 100 is unwound from fabric web roll 108. Retractable slide 116 conveys the leading edge of fabric web 100 a predetermined distance past a hemming station 122. The predetermined distance corresponds to the desired length of fabric strip 20. This distance may be varied based on the desired length of fabric strips 20.

At hemming station 122 a binding tape is applied laterally across fabric web 100. The binding tape is applied on either side or both sides of fabric web 100. The binding tape is applied to fabric web 100 such that the center of the binding tape is at the predetermined distance from the leading edge of fabric web. As will be explained below the binding tape forms bottom hem 75b on one fabric strip and top hem 75a of a second fabric strip.

As shown schematically in FIG. 11, hemming station 122 includes a cut and transfer apparatus 123. Cut and transfer apparatus 123 includes a pneumatic hitch feed which advances the binding tape from a supply roll through a guillotine cutoff and into a cutoff gripper. At the end of the feed stroke, the cutoff gripper clamps the material, and the binding tape is cut to length. The length being substantially equal to the width of fabric web 100.

The cutoff griper is mounted on a slide that will transfer the cut piece of binding tape to a second gripper on a pick-and-place slide. The pick and place slide with the second gripper transfers the cut piece of binding tape and places it across the top side of fabric web 100.

After the binding tape is transferred, an upper heated platen 124 located above fabric web 100 is lowered to adhere the cut piece of binding tape to the fabric web surface thereby adhering the binding tape to fabric web 100. Upper heated platen 124 includes two portions. A first portion is first lowered to clamp the portion of the binding tape extending from the second gripper. Once the exposed portion of the binding tape is secured by the first portion of upper heated platen 124, the second gripper releases the binding tape and the second portion of upper heated platen 124 is lowered and completes the bonding of the biding tape.

In a similar manner a subsequent piece of binding tape may be adhered to the underside of fabric web 100. It is possible to hem one or both sides of fabric web 100. In the preferred embodiment a second duplicate pick-and-place gripper is raised into position as the first pick-and-place slide transfers the first cut piece of binding tape to fabric web 100. The cutoff gripper at the cutoff which is mounted on a rotary actuator rotates a second cut piece of binding tape 180 degrees before transferring the piece of binding tape to a gripper on the second pick-and-place slide. The gripper on the second pick-and-place slide then applies the binding tape to the underside of fabric web 100 and a lower heated plated 124 is raised to secure the cut piece of binding tape to the underside of fabric web 100.

Similar to the upper heated platen, the lower heated platen has two portions. The first portion clamping the exposed portion of the biding tape followed by the release of the biding tape by the gripper on the second pick-and-place slide. The second portion of the heated platen is subsequently raised to secure and adhere the binding tape. In this manner the placement of the binding tape on the underside of fabric web 100 and operation of the lower heated platen 124 is similar to that described above with respect to the placement of the binding tape on the top side of fabric web 100 and operation of the upper heated platen.

Once the binding tape is secure, fabric web 100 is indexed to a punching station 126 having a first and second punch situated above each bead 72. First and second punches form aperture 74 in each bead 72, extending through fabric web 100. In the preferred embodiment apertures 74 have a diameter of approximately 0.050 inches and are located within the hem region approximately 1 inch from the center of the hem distal the leading edge of the fabric web.

Fabric web 100 may be subsequently indexed to a cutting station 128 having a cutting means aligned with the center of the hem. However, cutting station may be located proximate punching station 126 such that fabric web 100 need not be indexed. In the preferred embodiment the cutting means is a sonic slitter which traverses laterally across fabric web 100. The sonic slitter cuts through the center of the binding tape, cutting through fabric web 100, and each bead 72. In this manner half of the applied binding tape becomes bottom hem **75*b* of one fabric strip. Similarly, the other half of the applied binding tape becomes a top hem of the new leading edge of fabric web 100 which will become top hem 75*a* of subsequent fabric strip 20**.

The cut fabric strip is then removed for final assembly. The new leading edge is then conveyed the predetermined distance from hemming station 122 and the process of hemming, punching and cutting is repeated. These process steps are repeated thereby forming a plurality of fabric strips 20.

The first fabric strip formed utilizing the process described above will not have a top hem. Therefore the first fabric strip may be discarded. To minimize the amount of scrap, the predetermined distance the leading edge of fabric web 100 is conveyed beyond the hemming station at start up may be reduced.

The first two fabric strips 20 manufactured as outlined above that are cut to the predetermined length and having a top and bottom hem **75*a*, 75*b* are manually transferred to an assembly station 132. The first fabric strip, or end strip 20*a*, is attached to first end louver 16*a* at both front and rear sockets 34, 54 and is handled differently than the fabric strips 20 that are attached only to front sockets 34. The attachment of end fabric strip 20*a* and an adjacent fabric strip 20 to first end louver 16*a*** will now be described.

The first end fabric strip **20*a* and second adjacent fabric strip 20 are aligned such that second bead 72*b* from first end fabric strip 20*a* and first bead 72*a* of adjacent fabric strip 20 form cylindrical member 96. In this orientation, the front faces of each fabric strip 20*a*, 20 are in contact proximate the adjoining beads. First and adjacent fabric strips 20*a*, 20 are clamped proximate the top and bottom edges of each fabric strip proximate cylindrical member 96. First end fabric strip 20*a* is further clamped proximate first bead 72*a* of end fabric strip 20*a***.

Clip 22 is installed in apertures 74 between first and adjacent fabric strips. Additionally a rear end clip 23 is installed in aperture 74 in the free bead of first fabric strip. First end fabric strip **20*a* and adjacent fabric strip 20 are attached to end louver 16 by sliding rear socket 54 of first end louver 16*a* over first bead 72*a* of first end fabric strip 20*a*, and simultaneously sliding front socket 34 over cylindrical member 96. First end louver 16*a* is slid over bead 72*a* and cylindrical member 96 beginning proximate bottom edge of the fabric strips. First end louver 16*a* is slid over bead 72*a* and cylindrical member 96 until bottom surfaces 86 of clip heads 76 contact the top surface of front and rear sockets 34, 54**.

Once first end fabric strip **20*a* and second bead 72*a* of adjacent fabric strip 20 are attached to first end louver 16*a*, subsequent fabric strips 20 are attached to main louvers 14. Another cylindrical member 96 is subsequently formed with second bead 72*b* of the adjacent fabric strip and a first bead 72*a* of a subsequent fabric strip. These two fabric strips are clamped and another clip 22 is installed in apertures 74. Front socket 34 of main louver 14 is then slid over the cylindrical member 96 attaching the fabric strips 20 to main louver 96. This process is repeated until the blind assembly 10 has the desired number of louvers 14** and is the desired width.

In one embodiment, retractable slide 116 in addition to conveying fabric strip 20 simultaneously conveys louver 12. Louver 12 is conveyed such that socket 34 slides down the full length of the clamped cylindrical member 96. Retractable slide 116 then retracts to grip next fabric strip 20 and louver 12 while operators place the progressive assembly into a holding region and the next fabric strips 20 into the clamps.

The final fabric strip **20*a* is attached to a second end louver 16*b* as substantially described above with respect to first end louver 16*a*. However, in contrast to the assembly of the first end louver 16*a*, first bead of final fabric strip 20*a* is attached to front socket 34 of second end louver 16*b***.

As discussed above, each louver is attached to a carrier in the headrail by means of a fastener located within aperture 98. The size of weight 50 situated within louvers 12 is determined by the combined weight of socket 34 and fabric strips 20. However, where a weight 50 is not utilized, the moment created by the weight of socket 34 and fabric strips 20 is balanced by moving the location of aperture 98 toward front end 30 of louver 12.

When viewed from the front, louvers 12 are covered by fabric strips 20. Further, as to louvers 16*a*, 16*b* at each outer end of blind assembly 10, the outermost fabric strips 20*a* wraps around the outermost surface of the louver and attaches to rear edge 32 of louver 16*a*, 16*b*. When louvers 12 are rotated, especially outer end louvers 16*a*, 16*b*, they are not visible to the eye, but covered by the curtain 18, namely fabric strips 20. In this manner, the blind appears to be encased or encapsulated by the curtain 18 when viewed from the ends and in front.

While the specific embodiments have been illustrated and described, numerous modifications come to mind without significantly departing from the spirit of the invention and the scope of protection is only limited by the scope of the accompanying Claims.

What is claimed is:

1. A blind assembly comprising:

a plurality of elongated main louvers and a pair of end louvers, each main louver and each end louver having a leading edge and a rear edge, each main and end louver including a front socket adjacent the leading edge, the front socket having an interior, each end louver including a rear socket proximate the rear edge, the rear socket including a rear interior; and a curtain including a first end and a second end, the curtain having a plurality of parallel spaced longitudinal members attached thereto, the curtain disposed and passing adjacent each front leading edge of the main and end louvers, the first end of the curtain adjacent the rear edge of one end louver and the second end of the curtain adjacent the rear edge of the other end louver, each longitudinal member fitting within the front and rear sockets.

2. The blind assembly of claim 1, wherein the rear socket includes a rear passageway connecting the rear interior an exterior of the socket, wherein the rear passageway faces outward from the main louvers.

3. The blind assembly of claim 2, wherein the curtain is formed of a plurality of substantially rectangular substrates abutting at adjacent edges, each substrate having a semi-cylindrical bead attached to each marginal edge thereof, wherein each pair of abutting beads forms a cylindrical member, each cylindrical member is received within the interior of the front sockets, the ends of the curtain include a semi-cylindrical bead which is received within the rear interior of the rear socket of each end louver.

4. The blind assembly of claim 3, wherein the rear interior has a semi-cylindrical form with a radius greater than the radius of the semi-cylindrical bead.

5. The blind assembly of claim 4, wherein each main vane includes a channel proximate the rear edge, each channel including a weight configured to counter balance the front socket and curtain.

6. The blind assembly of claim 5 further including a plurality of main clips, each clip including a head having a bottom surface, and a planar member extending from the bottom surface, the planar member having at least one tab extending therefrom distal the head, the bottom surface of the clips are supported by a top surface of the sockets and the planar member extends downward within the interior of the socket, each fabric strip supportingly attached to the at least one tab.

7. The blind assembly of claim 6, wherein the planar member includes a pair of sides, the plurality of clips including a plurality of main clips and a pair of end clips, each main clip includes one tab extending from each side of the planar member, each end clip includes one tab extending from one side of the planar member.

8. A blind assembly comprising:

a headrail;

a plurality of elongated louvers, rotatably attached to the headrail at preselected, spaced relation to one another in a manner which enable each louver to rotate about a longitudinal axis of rotation, each louver having a leading edge and a socket adjacent the leading edge, the socket including an interior and a top surface, each louver including a rear edge and an elongated channel proximate the rear edge;

a curtain including a plurality of parallel longitudinal members attached thereto, the curtain disposed and passing adjacent each leading edge, each longitudinal member fitting within the interior of the socket; and a weight located within the channel configured to counterbalance the curtain and the members about the longitudinal axis of rotation.

9. The blind assembly of claim 8, further including a pair of end vanes, each end vane including a leading edge and a rear edge, each leading edge including a front socket, and each rear edge including a rear socket, wherein the curtain includes a first end having a longitudinal member located within the rear socket of one end vane, the curtain including a second end having a longitudinal member located within the rear socket of the other end vane.

10. The blind assembly of claim 9, further including a plurality of main clips, each clip including a head having a bottom surface, and a planar member extending from the bottom surface, the planar member having at least one tab extending therefrom distal the head, the bottom surface of the clips are supported by a top surface of the sockets, the planar member extending downward within the interior of the socket, and each fabric strip supportingly attached to the at least one tab.

11. The blind assembly of claim 10, wherein the curtain is formed of a plurality of substantially rectangular substrates abutting at adjacent edges, each substrate having a bead attached to each marginal edge thereof, wherein each member is formed of abutting beads; and each substrate having a top edge and a bottom edge, wherein each bead includes an aperture therethrough proximate the top edge of the substrate, each aperture being configured to receive one tab of the pair of tabs.

12. A blind assembly comprising:

a plurality of elongated louvers, each louver having a leading edge and a socket adjacent the leading edge, the socket including an interior, and a top surface;

a plurality of clips, each clip being suspended proximate the top surface of the socket; and a curtain including a plurality of parallel longitudinal members attached thereto, the curtain disposed and passing adjacent each front leading edge, each longitudinal member fitting within the interior of the socket and attached to the clip.

13. The blind assembly of claim 12, wherein each clip includes a head having a bottom surface, and a planar member extending from the bottom surface, the planar member having a pair of tabs extending therefrom distal the head.

14. The blind assembly of claim 13, wherein the curtain is formed of a plurality of substantially rectangular substrates abutting at adjacent edges, each substrate having a bead attached to each marginal edge thereof, wherein each member is formed of abutting beads; and each substrate having a top edge and a bottom edge, wherein each bead includes an aperture therethrough proximate the top edge of the substrate, each aperture being configured to receive one tab of the pair of tabs of each clip.

15. The blind assembly of claim 14, wherein the planar member of each clip is located intermediate each pair of beads and extending within the socket proximate the top surface, and the bottom surface of the clip is adjacent the top surface.

16. The blind assembly of claim 15, further including a pair of end vanes, each end vane including a leading edge and a rear edge, each leading edge including a front socket, and each rear edge including a rear socket, wherein the curtain includes a first end having a longitudinal member located within the rear socket of one end vane, the curtain including a second end having a longitudinal member located within the rear socket of the other end vane.

17. The blind assembly of claim 16, wherein each main vane includes a channel proximate the rear edge, each channel including a weight configured to counter balance the front socket and curtain.

18. A process for making a vertical blind assembly including a plurality of elongated louvers, the process comprising the steps of:

providing a socket at an edge of each louver;

forming a plurality of fabric strips, each fabric strip including a pair of marginal edges, each marginal edge having a generally semi-cylindrical bead attached thereto;

forming a plurality of generally cylindrical members from a bead of one fabric strip and a bead of a subsequent fabric strip; and placing one of the cylindrical members in the sockets of each louver.

19. The process of claim 18 wherein the step of forming the plurality of fabric strips includes applying beads to the marginal edges.

20. The process of claim 19 wherein the step of forming a plurality of fabric strips includes conveying a free end of the fabric web a set distance beyond a cutting station.

21. The process of claim 20 further including applying a hem transverse to the fabric web.

22. The process of claim 21 wherein the step of forming the plurality of fabric strips includes cutting the fabric web transverse to the marginal edges at a pre-determined set distance from the free end of the fabric web.

23. The process of claim 22 further including the step of forming an aperture through the beads.

24. The process of claim 22 further including the step of attaching a clip between the first and second beads of two adjoining fabric strips.

25. The process of claim 18 further including the step of attaching a bead of a first fabric strip to a rear edge of a first end louver and a bead of a last fabric strip to a rear edge of a second end louver.

* * * * *